US007685682B2

(12) United States Patent
Kiersz, II

(10) Patent No.: US 7,685,682 B2
(45) Date of Patent: Mar. 30, 2010

(54) METHOD AND APPARATUS FOR ATTACHING A BOUTONNIERE OR CORSAGE TO A GARMENT

(75) Inventor: Jeremy C. Kiersz, II, Rolla, MO (US)

(73) Assignee: JCK Industries LLC, Rolla, MO (US)

( * ) Notice: Subject to any disclaimer, the term of this patent is extended or adjusted under 35 U.S.C. 154(b) by 503 days.

(21) Appl. No.: 11/686,553

(22) Filed: Mar. 15, 2007

(65) Prior Publication Data

US 2008/0222850 A1 Sep. 18, 2008

(51) Int. Cl.
*A45F 5/08* (2006.01)

(52) U.S. Cl. ..... 24/6; 24/706

(58) Field of Classification Search ..... None
See application file for complete search history.

(56) References Cited

U.S. PATENT DOCUMENTS

| | | | | |
|---|---|---|---|---|
| 436,110 | A | 9/1890 | Wilcox | |
| 613,059 | A | 10/1898 | Briggs | |
| 1,418,760 | A | 6/1922 | Wertheimer | |
| 1,425,480 | A | 8/1922 | Hoffmann | |
| 2,486,848 | A | 11/1949 | Huck | |
| 3,570,070 | A | 3/1971 | Rose | |
| 3,735,447 | A | 5/1973 | Abraham | |
| 4,229,877 | A * | 10/1980 | Fagan | 29/509 |
| 4,477,946 | A | 10/1984 | Mafli | |
| D334,905 | S | 4/1993 | Ritz | |

(Continued)

FOREIGN PATENT DOCUMENTS

| | | |
|---|---|---|
| JP | 9111520 | 4/1997 |

(Continued)

OTHER PUBLICATIONS

English abstract of Japanese Patent No. JP9111520; http://v3.espacenet.com/textdoc?DB=EPODOC&IDX=JP9111520&F=0; 1 page.

(Continued)

*Primary Examiner*—Jack W. Lavinder
(74) *Attorney, Agent, or Firm*—Thompson Coburn LLP; Clyde L. Smith

(57) ABSTRACT

A boutonniere attachment device comprises a backing member and a pin member. The pin member is attached to the backing member and extends from the backing member to a pointed terminal end. The backing member can be engaged with a non-exterior surface of a portion of a garment while a portion of the pin member that includes the pointed terminal end is positioned external to the garment, and while at least part of the portion of the pin member extends at least partially through the stem of a boutonniere in a manner such that a portion of the stem is biased against the exterior surface of the portion of the garment and such that the portion of the garment is biased between the portion of the stem and the backing member.

19 Claims, 3 Drawing Sheets

U.S. PATENT DOCUMENTS

| | | | |
|---|---|---|---|
| 5,210,881 | A | 5/1993 | Stocker, Jr. et al. |
| 6,076,194 | A | 6/2000 | Purkett |
| 6,161,224 | A | 12/2000 | Tuetken |
| 6,199,218 | B1 | 3/2001 | Michael |
| D446,472 | S | 8/2001 | Davenport |
| 6,389,649 | B1 | 5/2002 | Metzler |
| 6,715,184 | B1 | 4/2004 | Droschak |
| 6,865,751 | B1 | 3/2005 | Brasher |
| 2006/0185234 | A1 | 8/2006 | Fitzgerald |

FOREIGN PATENT DOCUMENTS

| | | |
|---|---|---|
| JP | 3072563 | 8/2000 |

OTHER PUBLICATIONS

English translation of Japanese Patent No. JP3072563U; http://www4.ipdl.inpit.go.jp/cgi-bin/tran_web_cgi_ejje?atw_u=http%3A%2F%2Fwww4.ipdl.inpit.go.jp%...; 3 pages.

International Search Report for Application No. PCT/US2008/057103 mailed on Jul. 30, 2008, 3 pages.

Written Opinion of the International Searching Authority for Application No. PCT/US2008/057103 mailed on Jul. 30, 2008, 3 pages.

International Preliminary Report on Patentability for PCT/US2008/057103 filed Mar. 14, 2008, 5 pages.

* cited by examiner

METHOD AND APPARATUS FOR ATTACHING A BOUTONNIERE OR CORSAGE TO A GARMENT

BACKGROUND OF THE INVENTION

This invention is directed primarily to the floral industry. More particularly, this invention is directed to methods and apparatus for attaching boutonnieres and corsages to garments.

Many methods and devices have been developed and utilized to attach cut flowers to garments. Some of such devices are relatively costly to produce as compared to others. Additionally, some of such devices and methods are useful in only particular situations, such as when the garment is provided with a button hole or the like configured to receive the stem or stems of cut flowers. Furthermore, some of such devices fail to maintain the boutonnieres or corsages in a fixed position relative to the garments and therefore require frequent adjustments.

SUMMARY OF THE INVENTION

The present invention overcomes many of the disadvantages associated with prior art devices and methods of attaching boutonnieres and corsages to garments. For purposes of describing and claiming the invention, as used in this document, the term boutonniere should be understood as a meaning either a boutonniere or corsage. Similarly, the term garment is meant to generically refer any article of clothing including, but not limited to, a jacket, dress, pants, shirt, or blouse.

In one aspect of the invention, a method of attaching a boutonniere to a garment of a wearer comprises a step of providing a boutonniere attachment device. The boutonniere attachment device comprises a backing member and a pin member. The pin member has a pointed terminal end. Additionally, the pin member is attached to the backing member and extends from the backing member to the pointed terminal end. The method also comprises a step of positioning the boutonniere attachment device between the wearer and the portion of the garment and thereafter passing a portion of the pin member through the portion of the garment in a manner such that the portion of the pin member is external to the garment while the backing member remains positioned between the portion of the garment and the wearer. The portion of the pin member comprises the pointed terminal end. Still further, the method comprises a step of passing at least part of the portion of the pin member at least partially through the boutonniere in a manner such that a portion of the boutonniere presses against the garment in a manner securing the boutonniere to the garment.

In another aspect of the invention, a boutonniere attachment device is configured and adapted to secure a boutonniere to a garment and consists essential only of a backing member and a pin member. The backing member has opposite front and back faces, opposite side edges, opposite top and bottom edges, and upper and lower portions. Additionally, the backing member has a maximum width between the opposite side edges, a maximum height between the top and bottom edges, and a maximum thickness between the front and back faces. The maximum thickness is less than one fifth of the maximum width and less than one fifth of the maximum height. The maximum height is less than four times the maximum width. The maximum width is less than twice the maximum height. The pin member is attached to the backing member and has a pointed terminal end. The front of the backing member faces the pointed terminal end of the pin member. The pin member extends along a path from the lower portion of the backing member to the pointed terminal end. The path leads upward in a direction toward the upper edge and away from the front face of the backing member.

In yet another aspect of the invention, an assembly comprises a garment, a boutonniere, and a boutonniere attachment device. A portion of the garment has an exterior surface and an opposite surface. The boutonniere comprises a stem that is engaged with the exterior surface of the portion of the garment. The boutonniere attachment device comprises a backing member and a pin member. The pin member has a pointed terminal end. Additionally, the pin member is attached to the backing member and extends from the backing member to the pointed terminal end. The backing member is engaged with the opposite surface of the portion of the garment. A portion of the pin member that includes the pointed terminal end is positioned external to the garment. At least part of the portion of the pin member extends at least partially through the stem of the boutonniere in a manner such that a portion of the stem is biased against the exterior surface of the portion of the garment and such that the portion of the garment is biased between the portion of the stem and the backing member.

While the principal advantages and features of the invention have been described above, a more complete and thorough understanding of the invention may be obtained by referring to the drawing figures and the detailed description of the embodiments, which follow.

BRIEF DESCRIPTION OF THE DRAWING FIGURE

Figure 3:
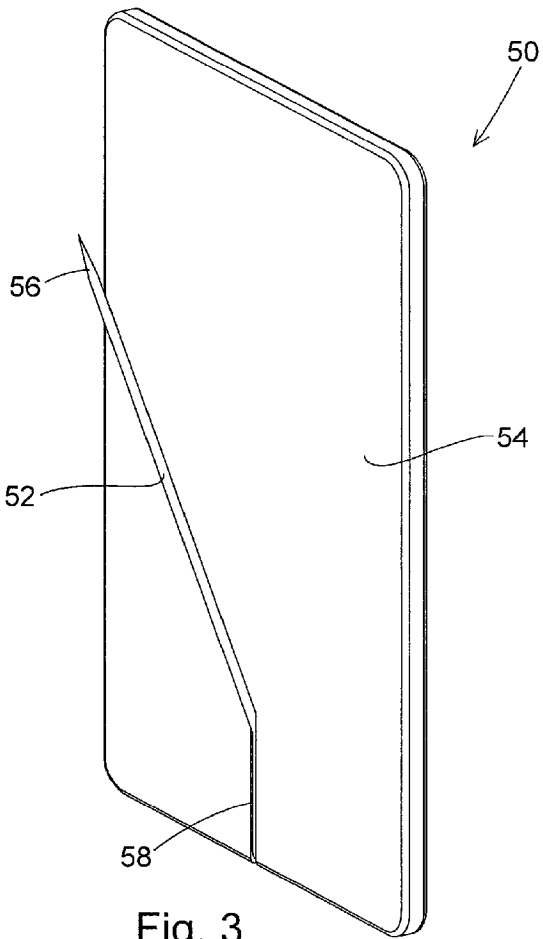
FIG. 3 is perspective view of an alternative embodiment of a boutonniere attachment device in accordance with the invention.

Reference numerals in the written specification and in the drawing figures indicate corresponding items.

DETAILED DESCRIPTION OF PREFERRED EMBODIMENTS OF THE INVENTION

Figure 1:
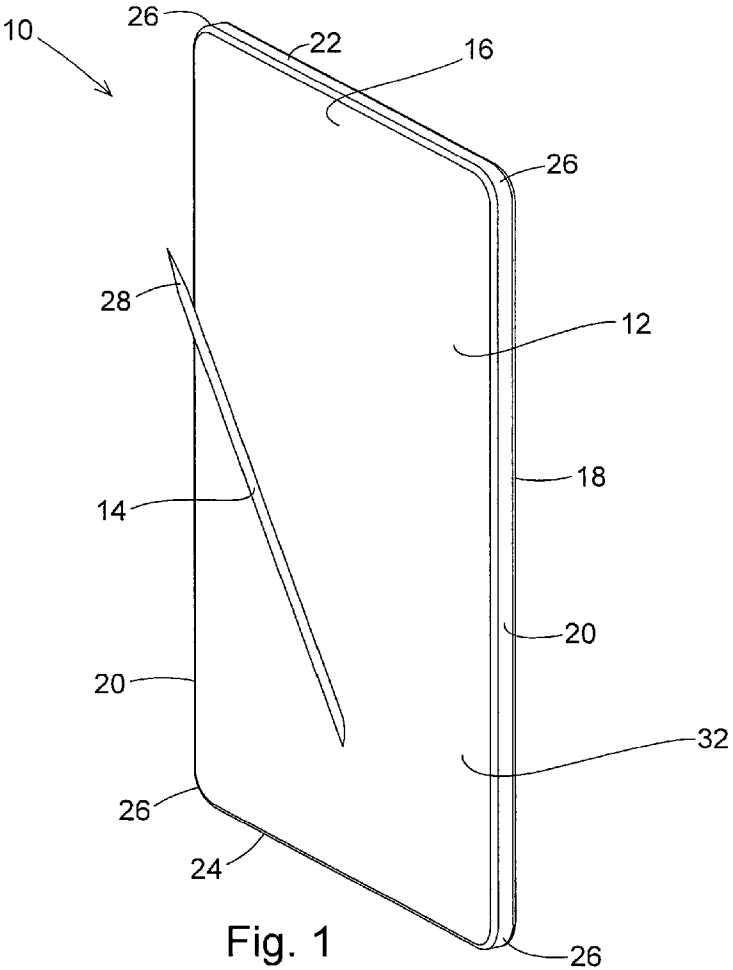
FIG. 1 is perspective view of a preferred embodiment of a boutonniere attachment device in accordance with the invention.

A boutonniere attachment device in accordance with the invention is shown by itself in FIG. 1 and is indicated by reference numeral 10. The boutonniere attachment device 10 comprises a backing member 12 and a pin member 14. The backing member 12 is preferably formed of a polymeric material, preferably via injection molding. The pin member 14 is preferably formed from metal wire and is preferably partially over-molded by the backing member 12 in a manner permanently securing the backing member and the pin member together.

The backing member 12 is preferably has a shape that takes the form of a thin rectangular sheet having opposite front 16 and back 18 faces. Each of the front 16 and back 18 faces is preferably planar and parallel to the other. The distance between the front 16 and back 18 faces of the backing member 12 defines a thickness of the backing member. The side edges 20 of the backing member 12 have a maximum distance therebetween that defines a width of the backing member. The top 22 and bottom 24 edges of the backing member 12 have a maximum distance therebetween that defines a height of the backing member. The height of the backing member 12 is preferably greater than its width. The width of the backing member 12 is preferably several times greater than its thickness. The side 20, top 22, and bottom 24 edges of the backing member 12 are shown as being generally straight, but need not be. Preferably, the corners 26 of the backing member 22 are rounded, as are most other portions of the backing member, so as not to be sharp. The lack of sharp edges on the backing member 12 helps limit the amount of wear the boutonniere attachment device 10 causes to garments when the device is in use.

The pin member 14 comprises a pointed terminal end 28. Opposite the pointed terminal end 28, the pin member 14 comprises another terminal end 30 around which the backing member 14 is molded. The pin member 14 is preferably formed in manner such that it extends from the lower portion 32 of the backing member 12 adjacent the backing member's bottom edge 24. From there, the pin member 14 preferably extends upward in front of the front face 16 of the backing member 12 to the pointed terminal end 28 of the pin member. Preferably, the portion of the pin member 14 adjacent its pointed terminal end 28 is straight and is preferably oriented such that it diverges away from the front face 16 of the backing member 12 at an angle of between ten and thirty degrees as it approaches said pointed terminal end. This being said, the portion of the pin member 14 that extends from the pointed terminal end 28 to the backing member 12 is preferably symmetric about a vertical plane that is perpendicular to the front face 16 of the backing member. The pointed terminal end 28 of the pin member 14 is preferably positioned beneath the top edge 22 of the backing member 12.

Figure 2:
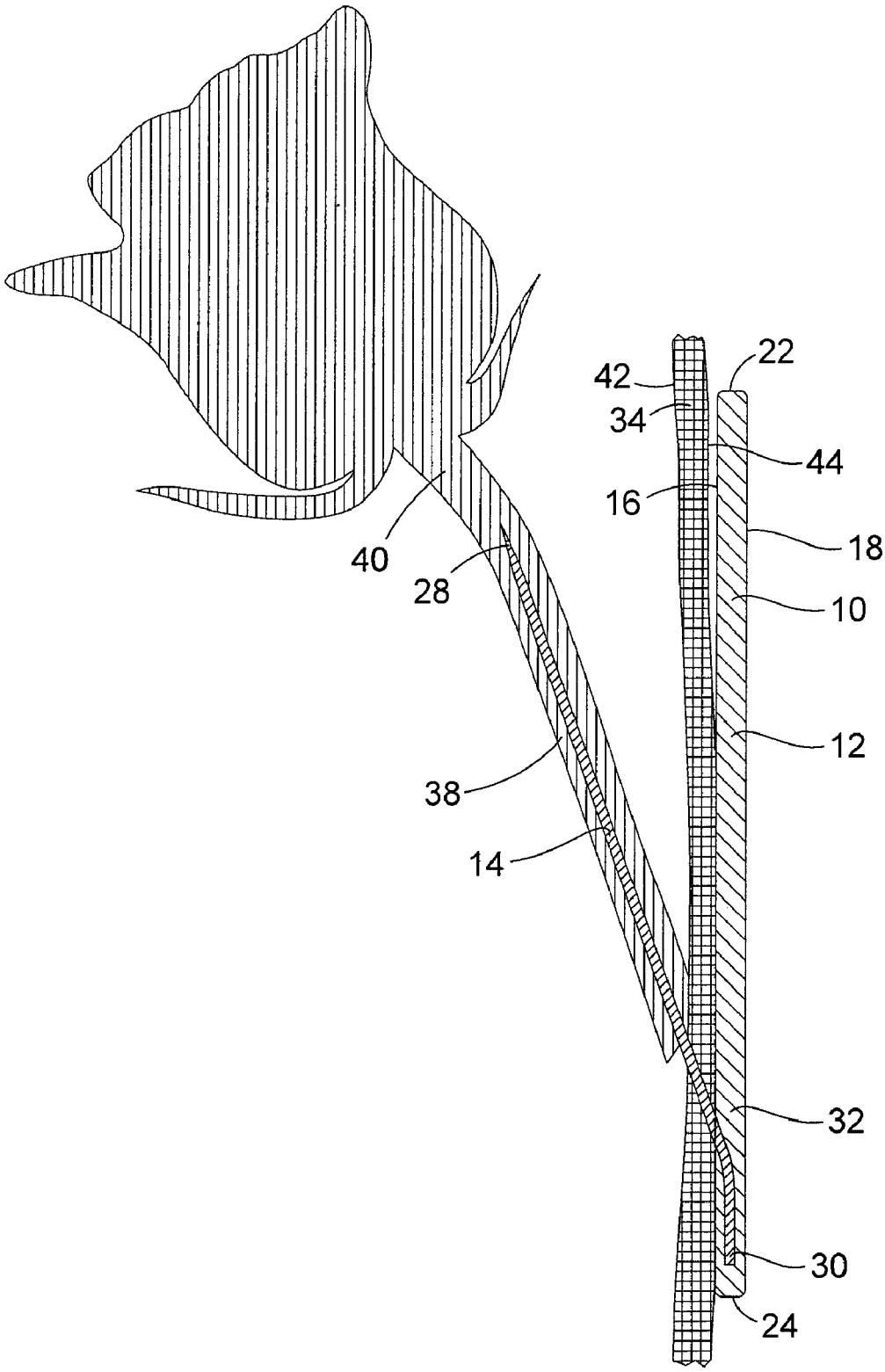
FIG. 2 is cross-sectional side elevation view of the device shown in FIG. 1 being used to attach a boutonniere to a garment, and is taken about the center of the device.

In use, the entire boutonniere attachment device 10 is preferably initially positioned between a portion of a garment 34 and a person wearing the garment. The pointed terminal end 28 of the pin member 14 is then forced through the portion of the garment 34, and then at least partially through a stem 38 of a boutonniere 40 to into the position shown in FIG. 2. Preferably, the stem 38 of the boutonniere 40 is oriented such that substantially all of the portion of the pin member 14 that is external to the garment 34, including the pointed terminal end 28, lies within the stem and is thereby concealed. The boutonniere attachment device 10 and the boutonniere 40 can be removed from the garment 34 by simply reversing the steps discussed above.

In view of the converging nature between the pin member 14 and the backing member 12 as the pin member extends downward from its pointed terminal end 28, the boutonniere attachment device 12 forces the stem 38 of the boutonniere 40 against the exterior surface 42 of the portion of the garment 34 and forces the front face 16 of the backing member against the opposite surface 44 of the portion of the garment. This biasing force and the resultant friction secures the boutonniere attachment device 10 and the boutonniere 40 to the portion of the garment 34 in a manner resisting undesirable relative movement between the boutonniere and the portion of the garment. Because the pointed terminal end 28 of the pin member 14 remains within the stem 38 of the boutonniere 40, the chance of a person being pricked by the boutonniere device 10 when its in use is less that it would otherwise be. In the unlikely event that the boutonniere 40 is inadvertently dislodged from the boutonniere attachment device 12, by configuring the pointed terminal end 28 to be below the top edge 22 of the backing member 12, the torso of the wearer is protected by the fact that the backing member lies between the wearer's torso and the pointed terminal end of the device.

Figure 4:
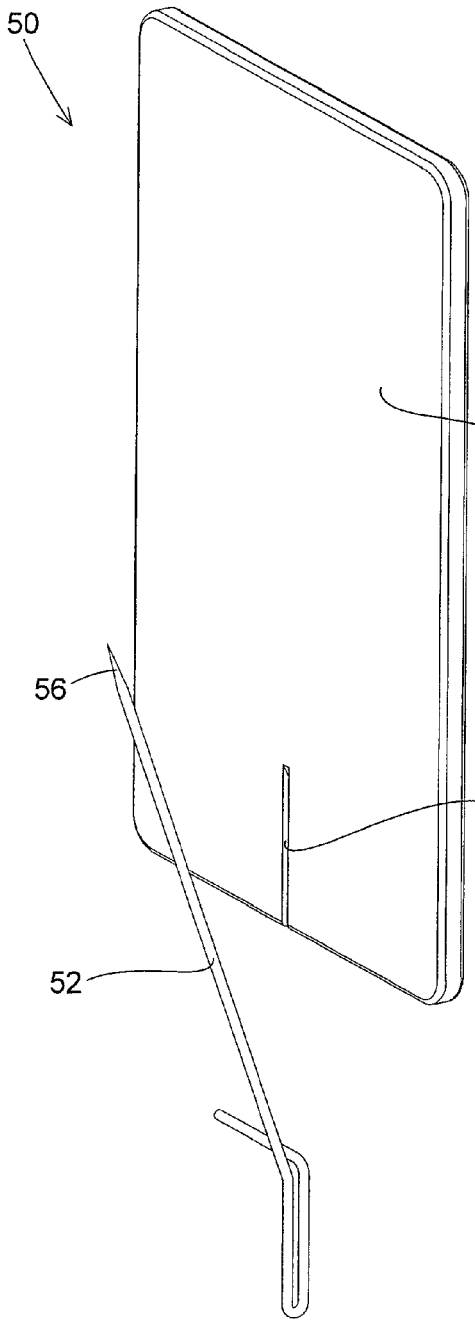
FIG. 4 is a exploded assembly view of the device shown in FIG. 3.
Figure 5:
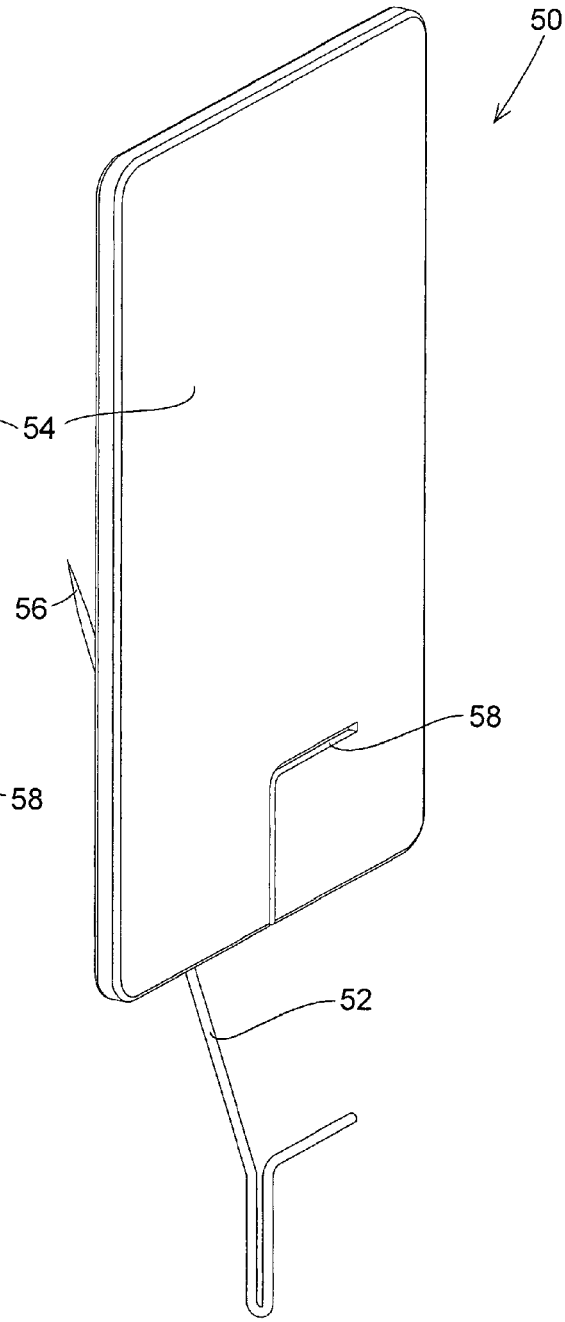
FIG. 5 is a exploded assembly view of the device shown in FIG. 3 as viewed from the rear.

An alternative embodiment of a boutonniere attachment device 50 in accordance with the invention is shown in FIGS. 3 and 4. This boutonniere attachment device 50 is utilized in a manner identical to the previously described device. However, unlike the boutonniere attachment device 10 first described, the pin member 52 and the backing member 54 of this boutonniere attachment device 50 are assembled to each other after each member has been formed separately. Preferably, the portion of the pin member 50 opposite its pointed terminal end 56 is configured to resiliently stretch over a portion of the backing member 54 when the pin member is assembled to the backing member. The backing member 54 is preferably configured and shaped such that at some point during the assembly procedure, the portion of the pin member 52 resilient deflects back at least partially to its undeflected configuration and thereby becomes geometrically interlocked with the backing member. Although the backing member 52 shown in FIGS. 3 and 4 comprises channels 58 for this purpose, it should be appreciated that a limitless number of alternative configurations could serve this purpose equally well.

While the present invention has been described in reference to specific embodiments, in light of the foregoing, it should be understood that all matter contained in the above description or shown in the accompanying drawings is intended to be interpreted as illustrative and not in a limiting sense and that various modifications and variations of the invention may be constructed without departing from the scope of the invention defined by the following claims. Thus, other possible variations and modifications should be appreciated.

Furthermore, it should be understood that when introducing elements of the present invention in the claims or in the above description of the preferred embodiment of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed.

What is claimed is:

1. A method of attaching a boutonniere to a garment of a wearer comprising:

providing a boutonniere attachment device, the boutonniere attachment device comprising a backing member and a pin member, the pin member having a pointed terminal end, the pin member being attached to the backing member and extending from the backing member to the pointed terminal end;

positioning the boutonniere attachment device between the wearer and a portion of the garment and thereafter passing a portion of the pin member through the portion of the garment in a manner such that the portion of the pin member is external to the garment while the backing member remains positioned between the portion of the garment and the wearer, the portion of the pin member comprising the pointed terminal end; and passing at least part of the portion of the pin member at least partially through the boutonniere in a manner such that a portion of the boutonniere presses against the garment in a manner securing the boutonniere to the garment.

2. A method in accordance with claim 1 wherein the step of passing at least part of the portion of the pin member at least partially through the boutonniere occurs in a manner such that the pointed terminal end of the pin member is positioned within the boutonniere when the boutonniere is secured to the garment.

3. A method accordance with claim 1 wherein the step of passing at least part of the portion of the pin member at least partially through the boutonniere occurs in a manner such that the portion of the garment is biased between the portion of the boutonniere and the backing member when the boutonniere is secured to the garment.

4. A method in accordance with claim 3 wherein the step of providing the boutonniere attachment device occurs in a manner such that the backing member comprises a sheet member having opposite front and back faces, an upper portion, and a lower portion and the pin member extends from the lower portion of the sheet member upwardly to the pointed terminal end in a manner such that the portion of the pin member diverges from the front face of the sheet member as the pin member extends to its pointed terminal end, and wherein the step of passing at least part of the portion of the pin member at least partially through the boutonniere further occurs in a manner such that the portion of the garment is biased between the portion of the boutonniere and the front face of the sheet member when the boutonniere is secured to the garment.

5. A method in accordance with claim 4 wherein the step of providing the boutonniere attachment device occurs in a manner such that the front face of the sheet member is flat, the portion of the pin member is straight, and the portion of the pin member diverges from the front face at an angle of not less than ten-degrees and not more than thirty-degrees.

6. A method in accordance with claim 4 wherein the step of providing the boutonniere attachment device occurs in a manner such that the upper portion of the sheet member has an uppermost edge, and the pointed terminal end of the pin is positioned below the uppermost edge of the sheet member when the boutonniere attachment device secures the boutonniere to the garment as recited.

7. Method in accordance with claim 1 wherein the backing member is positioned between the wearer and the pointed terminal end of the pin member when the boutonniere attachment device secures the boutonniere to the garment as recited.

8. A method in accordance with claim 1 consisting essentially of only the steps enumerated.

9. A boutonniere attachment device configured and adapted to secure a boutonniere to a garment, the device consisting essential only of:

a backing member having opposite front and back faces, opposite side edges, opposite top and bottom edges, and upper and lower portions, the backing member having a maximum width between the opposite side edges, a maximum height between the top and bottom edges, and a maximum thickness between the front and back faces, the maximum thickness being less than one fifth of the maximum width and less than one fifth of the maximum height, the maximum height being less than four times the maximum width, the maximum width being less than twice the maximum height, at least a portion of the front face of the backing member being planer; and a pin member attached to the backing member and having a pointed terminal end, the front of the backing member facing the pointed terminal end of the pin member, the pin member extending along a path from the lower portion of the backing member to the pointed terminal end, the path leading upward in a direction toward the upper edge and away from the front face of the backing member, the path lying in a vertical plane, at least a portion of the pin member alone the path being straight, the straight portion of the pin member being oriented no more than thirty-degrees from the planar surface and no less than ten-degrees from the planer surface.

10. A boutonniere attachment device in accordance with claim 9 wherein the front and back faces of the backing member are planar and parallel to each other.

11. A boutonniere attachment device in accordance with claim 10 wherein the top an bottom edges are horizontal and the side edges are vertical.

12. An assembly comprising:

a garment, a portion of the garment having an exterior surface and opposite surface;

a boutonniere, the boutonniere comprising a stem that is engaged with the exterior surface of the garment; and a boutonniere attachment device, the boutonniere attachment device comprising a backing member and a pin member, the pin member having a pointed terminal end, the pin member being attached to the backing member and extending from the backing member to the pointed terminal end, the backing member being engaged with the opposite surface of the portion of the garment, a portion of the pin member that includes the pointed terminal end is positioned external to the garment, at least part of the portion of the pin member extends at least partially through the stem of the boutonniere in a manner such that a portion of the stem is biased against the exterior surface of the portion of the garment and such that the portion of the garment is biased between the portion of the stem and the backing member.

13. An assembly in accordance with claim 12 wherein the backing member comprises a sheet member having opposite front and back faces, an upper portion, and a lower portion and the pin member extends from the lower portion of the sheet member upwardly to the pointed terminal end in a manner such that the portion of the pin member diverges from the front face of the sheet member as the pin member extends to its pointed terminal end, and the portion of the garment is biased between the portion of the boutonniere and the front face of the sheet member.

14. An assembly in accordance with claim 13 wherein the front face of the sheet member is flat, the portion of the pin member is straight, and the portion of the pin member diverges from the front face at an angle of not less than ten-degrees and not more than thirty-degrees.

15. An assembly in accordance with claim 13 wherein the upper portion of the sheet member has an uppermost edge, and the pointed terminal end of the pin is positioned below the uppermost edge of the sheet member when the boutonniere attachment device secures the boutonniere to the garment as recited.

16. An assembly in accordance with claim 12 wherein the backing member has opposite front and back faces, opposite side edges, and opposite top and bottom edges, the backing member has a maximum width between the opposite side edges, a maximum height between the top and bottom edges, and a maximum thickness between the front and back faces, the maximum thickness is less than one fifth of the maximum width and less than one fifth of the maximum height, the maximum height is less than four times the maximum width, and the maximum width is less than twice the maximum height.

17. An assembly in accordance with claim 16 wherein the backing member comprises an upper portion and a lower portion and the pin member extends from the lower portion of the backing member upwardly to the pointed terminal end in a manner such that the portion of the pin member diverges from the front face of the backing member as the pin member extends to its pointed terminal end, and the portion of the garment is biased between the portion of the boutonniere and the front face of the backing member.

18. An assembly in accordance with claim 17 wherein the front face of the backing member is flat, the portion of the pin member is straight, and the portion of the pin member diverges from the front face at an angle of not less than ten-degrees and not more than thirty-degrees.

19. An assembly in accordance with claim 18 wherein the upper portion of the backing member has an uppermost edge, and the pointed terminal end of the pin is positioned below the uppermost edge of the backing member when the boutonniere attachment device secures the boutonniere to the garment as recited.

* * * * *